US008953834B2

(12) United States Patent
Kim

(10) Patent No.: US 8,953,834 B2
(45) Date of Patent: Feb. 10, 2015

(54) FLAT-PANEL SPEAKER HAVING A MULTILAYER PCB PATTERN VOICE COIL FILM

(75) Inventor: Dong-Man Kim, Seoul-si (KR)

(73) Assignee: Exelway Inc., Seoul (KR)

( * ) Notice: Subject to any disclaimer, the term of this patent is extended or adjusted under 35 U.S.C. 154(b) by 0 days.

(21) Appl. No.: 14/116,385

(22) PCT Filed: Apr. 16, 2012

(86) PCT No.: PCT/KR2012/002872

§ 371 (c)(1),
(2), (4) Date: Nov. 25, 2013

(87) PCT Pub. No.: WO2012/153921

PCT Pub. Date: Nov. 15, 2012

(65) Prior Publication Data

US 2014/0105445 A1 Apr. 17, 2014

(30) Foreign Application Priority Data

May 11, 2011 (KR) ..... 10-2011-0043807

(51) Int. Cl.

| | |
|---|---|
| ***H04R 25/00*** | (2006.01) |
| ***H04R 1/00*** | (2006.01) |
| ***H04R 9/04*** | (2006.01) |
| *H04R 7/04* | (2006.01) |

(52) U.S. Cl.

CPC ..... *H04R 1/00* (2013.01); *H04R 9/047* (2013.01); *H04R 2209/041* (2013.01); *H04R 7/04* (2013.01)

USPC ..... 381/431; 381/401; 381/408

(58) Field of Classification Search

USPC ..... 381/182, 186, 399, 400, 401, 402, 407, 381/408, 409, 410, 431

See application file for complete search history.

(56) References Cited

U.S. PATENT DOCUMENTS

| | | | | |
|---|---|---|---|---|
| 3,873,784 | A * | 3/1975 | Doschek | 381/186 |
| 6,175,637 | B1 * | 1/2001 | Fujihira et al. | 381/412 |
| 2011/0274309 | A1 * | 11/2011 | Doh et al. | 381/398 |

* cited by examiner

*Primary Examiner* — Huyen D Le
(74) *Attorney, Agent, or Firm* — Occhiuti & Rohlicek LLP

(57) ABSTRACT

The present invention relates to a flat-panel speaker, and more particularly, to a flat-panel speaker having a multilayer PCB pattern voice coil film, which enables induced electromotive force to be increased by controlling the impedance of the multilayer voice coil film. The flat panel speaker having the multilayer PCB pattern voice coil film according to the present invention is characterized in that the voice coil comprises: a PCB (printed circuit board) pattern printed thereon and voice coil films stacked in an even number of 4 layers or more. Two layers each of said voice coil films are mutually connected in series, and the serially-connected voice coil films are connected to each other in parallel.

7 Claims, 4 Drawing Sheets

FLAT-PANEL SPEAKER HAVING A MULTILAYER PCB PATTERN VOICE COIL FILM

CROSS REFERENCE TO RELATED APPLICATION

This application is the national phase under 35 USC 371 of international application no. PCT/KR2012/002872, filed Apr. 16, 2012, which claims the benefit of the priority date of Korean application no. 10-2011-0043807, filed May 11, 2011. The contents of the aforementioned applications are incorporated herein in their entirety.

TECHNICAL FIELD

The present invention relates to a flat type speaker and, more particularly, to a flat type speaker having multi-layer PCB pattern voice coil films, which has been implemented to increase induced electromotive force through control of the impedance of multi-layer voice coil films.

BACKGROUND ART

A voice coil plate used in a flat type speaker is wound in an elliptical form and print-patterned on one side or both sides of a coil base of a plate form.

When current flows through a voice coil, the voice coil plate generates a magnetic field that is expanded and contracted around the voice coil in the same frequency as that of an audio signal by means of the flowing current. Since the magnetic field generated from the magnets within the speaker unit is applied to the voice coil, the voice coil plate moves up and down in response to the magnetic field while interacting with the magnetic field generated from the voice coil. Since the voice coil plate is connected to the vibration plate of the speaker unit, the vibration plate pushes air by way of the up and down movements and thus sound is generated by the vibration of the air.

Such a flat type speaker is being developed to have a gradually slim and long structure in line with an increase of an output capacity. Furthermore, in order to increase the output capacity of the flat type speaker, the development of a flat type speaker having a plurality of magnetic circuits connected emerges as an important problem.

In the case of voice coil film stacked in multiple layers, the number of turns needs to be increased to a maximum extent in order to increase induced electromotive force, but this is inefficient because a resistance value is increased in response to an increase of the number of turns. If a resistance value is preset, induced electromotive force cannot be increased because the number of turns cannot be increased, with the result that there is a difficulty in implementing a high-output speaker.

DISCLOSURE

Technical Problem

The present invention has been made to solve the above problems, and the present invention proposes a flat type speaker having a multi-layer PCB pattern voice coil film, which can significantly increase induced electromotive force by increasing the number of coil turns of PCB pattern voice coil film stacked in multiple layers in order to increase maximum induced electromotive force and also accurately control and manage a target resistance value of all the PCB pattern voice films.

Technical Solution

A flat type speaker having a multi-layer Printed Circuit Board (PCB) pattern voice coil film in accordance with the present invention for solving the above-described problems includes voice coil films having voice coils printed on the voice coil films in PCB patterns and stacked in 4-layer or more even-numbered layers, wherein the voice coil film are connected in series by two, and the serially connected voice coil films are connected in parallel.

Here, the multi-layer PCB pattern voice coil film satisfies the following equation. $L=2(n+1)$, and $R_{layer}=\frac{1}{2}*R_{spec}(n+1)$, wherein L is the number of PCB layers, $R_{layer}$ is a design resistance value of each PCB layer, $R_{spec}$ is a target total resistance value of all the PCB layers, and n is a positive integer.

Here, the voice coil preferably is subject to pattern printing in a track form, the serial connection between the voice coil films is formed by a connection between the inside front ends of the voice coils of the track form, and the parallel connection between the serially connected voice coil films is formed by a connection between the outside front ends of the voice coils of the track form.

Here, the serial and parallel connections between the voice coil films preferably are performed through holes formed in the PCBs.

Here, the through holes are formed at locations corresponding to an inside front end and outside front end of the voice coil of a track form, two through holes are formed in response to the outside front end, and an through hole corresponding to the inside front end satisfies the following equation. $L=2(n+1)$, and $N=\frac{1}{2}*L$, wherein L may be the number of PCB layers, N may be the number of through holes formed in the PCB at a location corresponding to the inside front end of the voice coil, and n may be a positive integer.

The parallel connection between the voice coil films preferably is shorted and formed on an input side of a power source and is shorted and formed on an output side of the power source.

Here, the serial and parallel connections between the voice coil films may be formed through through holes formed in the PCBs, and the through holes may be implemented to be formed by perforating all layers or necessary layers in a state in which the voice coil films have been stacked or in a process of stacking the voice coil films so that all the layers or the necessary layers are connected in series and in parallel through electrical plating of all the layers or the necessary layers.

Advantageous Effects

In accordance with the above-described construction of the present invention, in the case of a multi-layer PCB pattern voice coil, to increase induced electromotive force to a maximum extent is an essential factor in producing a high-output/high-efficiency speaker. A high-output, high-efficiency, inexpensive, and good-quality flat type speaker can be provided by winding multi-layer PCB voice coils to a maximum extent and also accurately controlling and managing a target total resistance value.

MODE FOR INVENTION

Hereinafter, the structures of the magnet plate and the base frame of a flat type speaker in accordance with the present invention are described with reference to the accompanying drawings.

Figure 1:
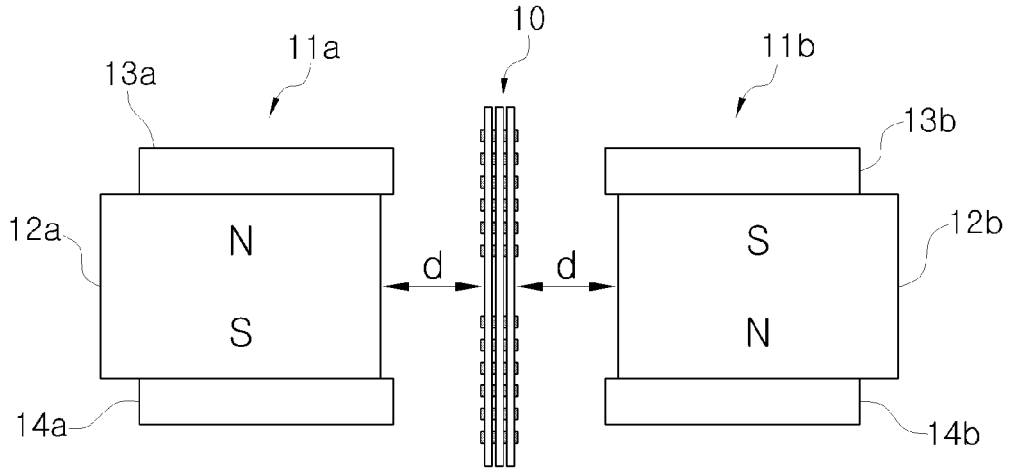
FIG. 1 is a schematic diagram of a flat type speaker having a multi-layer PCB pattern voice coil film in accordance with the present invention.

FIG. 1 is a schematic diagram of a flat type speaker having a multi-layer PCB pattern voice coil film in accordance with the present invention.

A flat type speaker to which a voice film is applied according to the present invention is shown in FIG. 1. The flat type speaker includes a pair of magnetic bodies 11*a* and 11*b* spaced apart from each other at a specific interval and formed to face each other and a voice coil film 10 interposed between the pair of magnetic bodies 11*a* and 11*b*.

The pair of magnetic bodies 11*a* and 11*b* that face each other have the same construction and may include permanent magnets 12*a* and 12*b*, upper yokes 13*a* and 13*b* placed on top surfaces of the permanent magnets 12*a* and 12*b*, and lower yokes 14*a* and 14*b* placed on bottom surfaces of the permanent magnets 12*a* and 12*b*.

The permanent magnets 12*a* and 12*b* provided within the magnetic bodies 11*a* and 11*b* that face each other have opposite polarities such that attraction can act on between the permanent magnets 12*a* and 12*b*. The voice coil film 10 preferably maintains the same distance 'd' from the magnetic bodies 11*a* and 11*b* on both sides of the voice coil film 10 such that the voice coil film 10 is subject to the same magnetic force from the magnetic bodies 11*a* and 11*b*.

The speaker constructed as above is mounted within a base frame (not shown), and a vibration plate (not shown) for transferring vibration energy is formed over the voice coil film 10.

The voice coil film 10 is formed of multiple layers stacked in 4-layer or more even-numbered layers 4, 6, 8, . . . . A 4-layer voice coil film is shown in FIG. 1.

The electrical connect structures of voice coil films having 4-layer or more multi-layers are described with reference to FIGS. 2 to 5.

A flat type speaker having a multi-layer PCB pattern voice coil film having an electrical connection structure, such as FIGS. 2 to 5, can increase an existing number of PCB pattern turns up to 2 times to 3 times because only the resistance value of one layer has only to be managed while increasing the number of turns to a maximum extent and can implement a high-output speaker because induced electromotive force is greatly increased.

In general, in a multi-layer voice coil structure, if a resistance value is 4Ω and 8Ω, only the number of 20 to 25 turns can be wound on a structure stacked in four layers because it is difficult to manage a resistance value. In accordance with a bonding method of the present invention, the number of 50 to 60 turns can be wound on a 4-layer stack structure, and the number of turns can be further increased as the line diameter of a PCB pattern becomes thin.

Figure 2:
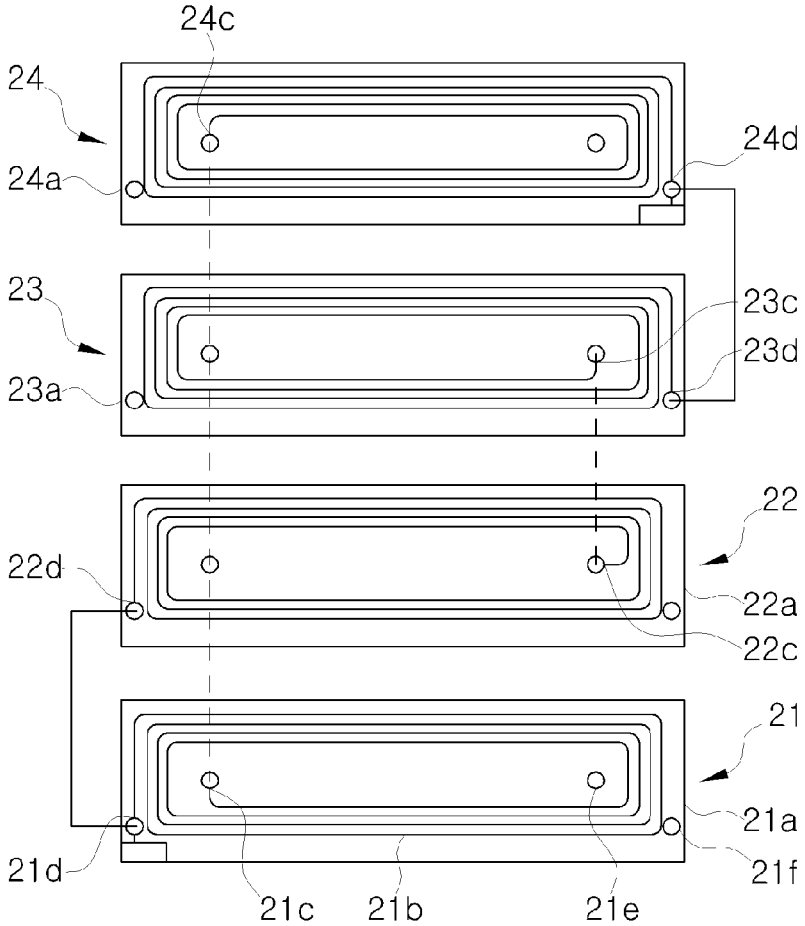
FIG. 2 is a plan view showing a serial and parallel connection structure in the 4-layer stack structure of a multi-layer PCB pattern voice coil film in accordance with the present invention.
Figure 3:
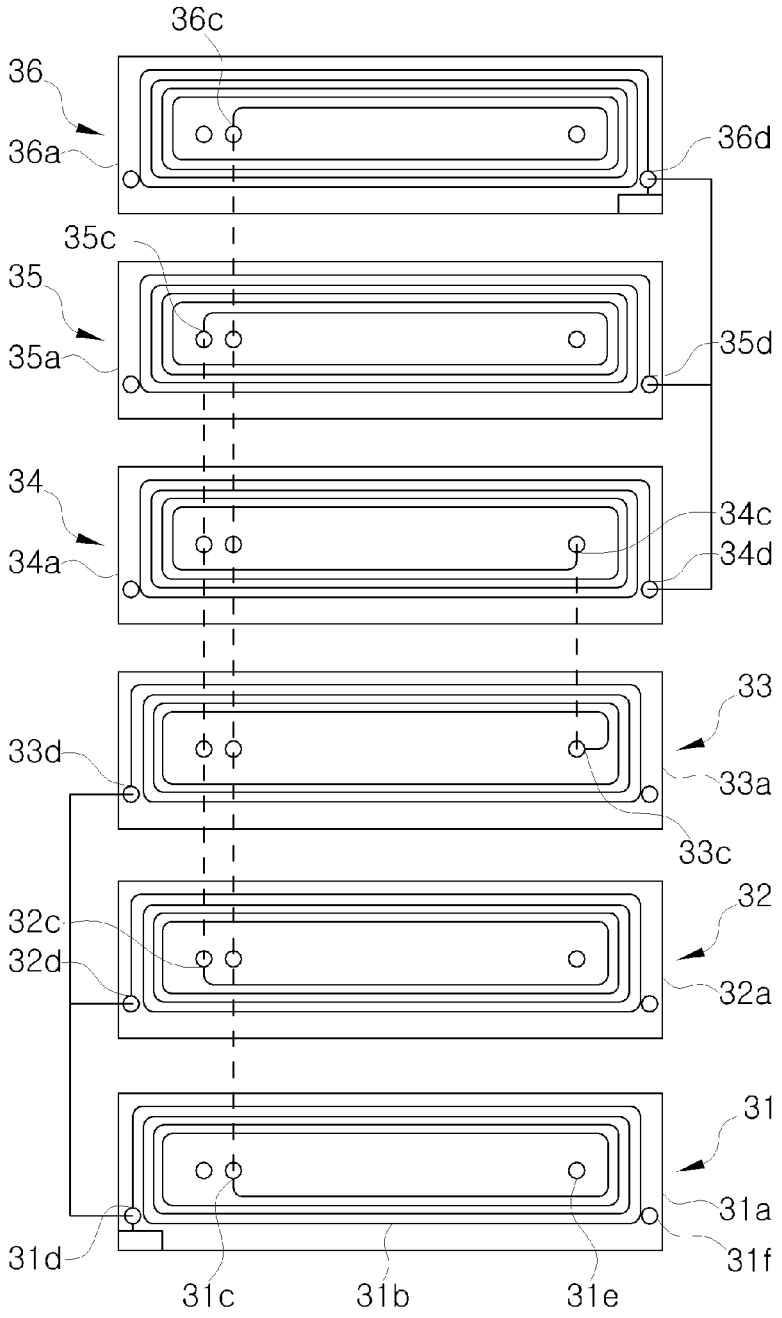
FIG. 3 is a plan view showing a first serial and parallel connection structure in the 6-layer stack structure of a multi-layer PCB pattern voice coil film in accordance with the present invention.
Figure 4:
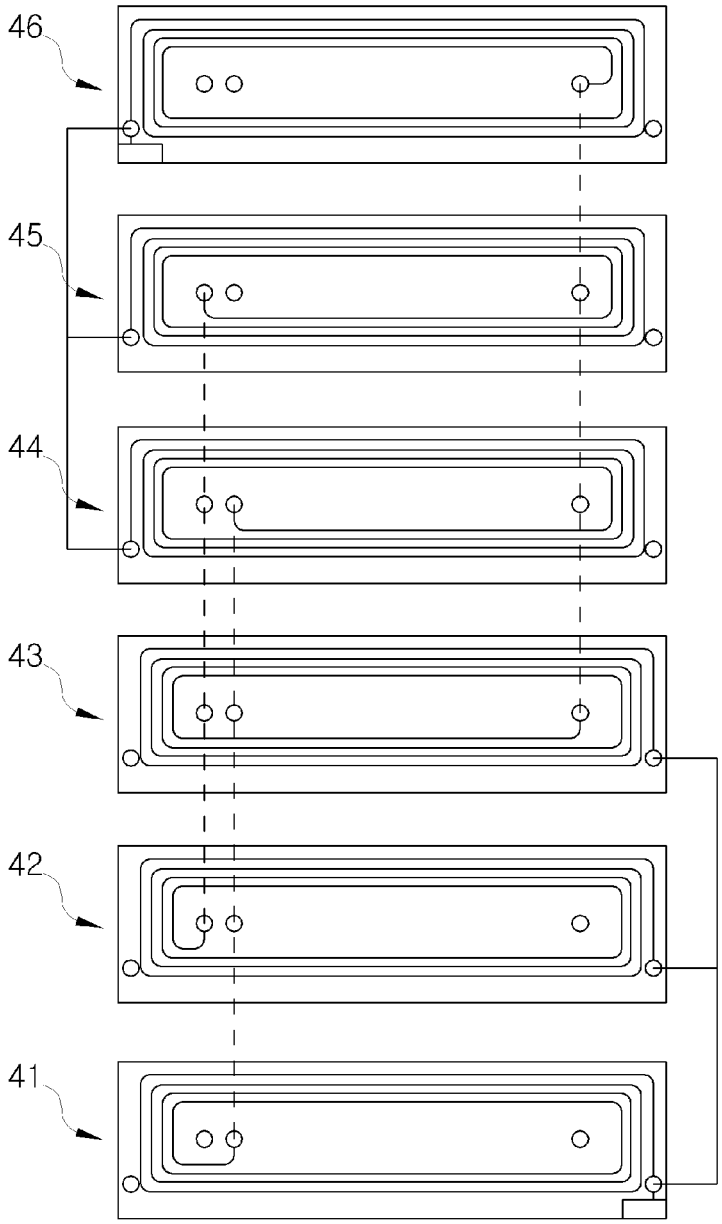
FIG. 4 is a plan view showing a second serial and parallel connection structure in the 6-layer stack structure of a multi-layer PCB pattern voice coil film in accordance with the present invention.
Figure 5:
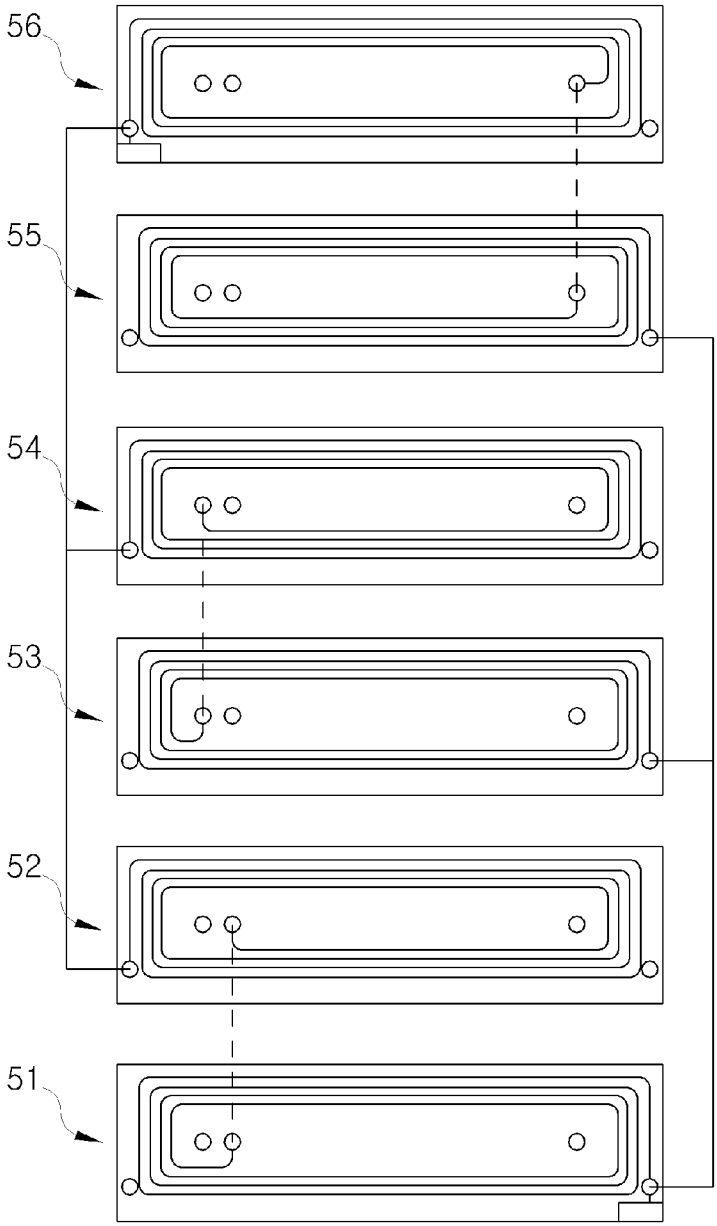
FIG. 5 a plan view showing a third serial and parallel connection structure in the 6-layer stack structure of a multi-layer PCB pattern voice coil film in accordance with the present invention.

FIG. 2 is a plan view showing a serial and parallel connection structure in the 4-layer stack structure of a multi-layer PCB pattern voice coil film in accordance with the present invention, and FIGS. 3 to 5 show the 6-layer PCB pattern voice coil film connection structures of flat type speakers having a multi-layer PCB pattern voice coil film in accordance with the present invention.

In the examples shown in FIGS. 2 to 5, a voice coil film stacked in four layers or six layers shows separated plane states, for convenience of description.

The examples shown in FIGS. 2 to 5 are illustrated as being preferred embodiments, and multi-layer PCB pattern voice coil film structures having various shapes of serial and parallel connection structures are possible.

If a total resistance value of the PCB pattern voice coil of a multi-layer structure is preset as in the case of FIGS. 2 to 5, a resistance value of each layer can be aware prior to PCB patterning although a voice coil is formed of what number. This principle is described below using Equation 1.

$$L=2(n+1), R_{layer}=\tfrac{1}{2}*R_{spec}(n+1) \quad \text{[Equation 1]}$$

wherein L is the number of PCB layers (4-layer or more), $R_{layer}$ is a design resistance value of each PCB layer, $R_{spec}$ is a target total resistance value of all the PCB layers, and n is a positive integer.

For example, assuming that a target total resistance value is set to 16Ω, the voice coils of respective layers are subject to PCB patterning such that $R_{layer}$ (a design resistance value of each PCB layer) is implemented to be 16Ω because n=2 if the voice coil film has four layers, $R_{layer}$ is implemented to be 24Ω because n=1 if the voice coil film has 6 layers, $R_{layer}$ is implemented to be 32Ω because n=3 if the voice coil film has 8 layers, and $R_{layer}$ is implemented to be 40Ω because n=1 if the voice coil film has 10 layers. Thereafter, as in FIGS. 2 to 5, the voice coils of the layers are connected in series by two layers, and one ends and the other ends of the serially connected voice coils and one ends and the other ends of another serially connected voice coils are shorted, thereby forming the entire multi-layer structure voice coil PCB pattern.

Furthermore, as in the case of FIGS. 2 to 5, through holes are formed in PCBs in order to enable such connections. Through holes 21*e* and 31*e* are formed in PCBs 21*a* to 24*a* and 31*a* to 36*a* at locations corresponding to the inside front ends 21*c* and 31*c* and the outside front ends 21*d* and 31*d* of voice coils 21*b* and 31*b*.

The number of through holes formed on the outside on both sides of each of the PCBs in response to each of the outside front ends 21*d* and 31*d* is 2, and the number of through holes formed on the inside on the PCB in response to each of the inside front ends 21*c* and 31*c* is variable.

The number of through holes corresponding to the outside front end is 2 and may have a fixed value irrespective of the number of stacked layers, but through holes corresponding to the inside front end is calculated as in Equation 2 below.

$$L=2(n+1), \text{ and } N=\tfrac{1}{2}*L \quad \text{[Equation 2]}$$

wherein L is the number of PCB layers, N is the number of through holes formed in the PCB at a location corresponding to the inside front end of a voice coil, and n is a positive integer.

The through holes corresponding to the inside front ends 21*c* and 31*c* are for coupling voice coil films 21 to 24 or 31 to 36 in series by two, and the through holes corresponding to the outside front ends 21*d* and 31*d* are for shorting one ends and the other ends of the voice coil films 21 to 24 or 31 to 36 that are connected in series by two and coupling the voice coil films 21 to 24 or 31 to 36 in parallel.

The variable number of through holes corresponding to the inside front ends 21*c* and 31*c* is for preventing the serial connection of one pair of voice coils from being shorted with the other pair of voice coils when the inside front ends are connected in series. That is, a 4-layer stack voice coil film requires two through holes because 4 voice coil films are internally connected in series by two lines. In contrast, a 6-layer stack voice coil film requires three serial connection lines because 6 voice coil films are internally connected in series by two so that the 6 voice coil films are prevented from being shorted through three through holes. Likewise, an 8-layer or more stack voice coil film has the number of through holes corresponding to inside front ends according to Equation 2.

A serial and parallel connection structure in a 4-layer stack structure is described based on the above description with reference to FIG. 2.

If a total resistance value $R_{spec}$ of a 4-layer PCB pattern voice coil film is set to 8Ω, the voice coil of each layer needs to be and can be designed to be 8Ω based on the line diameter and length of PCB copper foil and Equations 1 and 2, and the number of through holes corresponding to an inside front end is set to 2 so that serial and parallel connections are possible.

FIG. 2 has a structure in which the first-layer and the fourth-layer voice coil films 21 and 24 and the second-layer and the third-layer voice coil films 22 and 23 are connected in series, and the first-layer and the second-layer voice coil films 21 and 22 and the third-layer and the fourth-layer voice coil films 23 and 24 are connected in parallel.

The number of turns and resistance values of the voice coil films 21 to 24 of the respective layers are identically designed, and the inside front end 21*c* of the first-layer voice coil 21 and the inside front end 22*c* of the second-layer voice coil film 22 are connected through the through hole 21*e* of the PCB 21*a* such that the first-layer voice coil film 21 and the second-layer voice coil film 22 are connected in series.

If the 2-layer voice coil serial connection is completed as described above, a resistance value becomes 16Ω, that is, 8Ω+8Ω.

Likewise in the same method as that of the first-layer and the fourth-layer voice coil films 21 and 24, when the second-layer and the third-layer voice coil films 22 and 23 are connected in series, a resistance value becomes 16Ω, that is, 8Ω+8Ω.

Thereafter, when the outside front end 21*d* of the first-layer voice coil film 21 and the outside front end 22*d* of the second-layer voice coil film 22 are connected and the outside front end 23*d* of the third-layer voice coil film 23 and the outside front end 24*d* of the fourth-layer voice coil film 24 are connected through the through hole, a structure in which the first-layer and the second-layer voice coil films 21 and 22 and the third-layer and the fourth-layer voice coil films 23 and 24 are connected in parallel is obtained.

That is, the first-layer voice coil film 21 and the fourth-layer voice coil film 24 are connected in series, the second-layer voice coil film 22 and the third-layer voice coil film 23 are connected in series, the first-layer and the second-layer voice coil films 21 and 22 are connected in parallel, and the third-layer and the fourth-layer voice coil films 23 and 24 are connected in parallel, becoming 16Ω/2. As a result, the PCB pattern voice coil film having a total resistance value of 8Ω is completed.

Likewise, the first-layer and the second-layer voice coil films 21 and 22 may be connected in series, the third-layer and the fourth-layer voice coil films 23 and 24 may be connected in series, and the first-layer and the fourth-layer voice coil films 21 and 24 and the second-layer and the third-layer voice coil films 22 and 23 may be connected in parallel.

In such a stack structure, the serial and parallel connection patterns preferably are connected through the through holes corresponding to the inside front ends 21*c* to 24*c* of the voice coils when the serial connection is performed and preferably are connected through the through holes corresponding to the outside front ends 21*d* to 24*d* of the voice coils when the parallel connection is performed.

Furthermore, in the above-described stack structure of the voice coil film, the following conditions are necessary in order to manage an accurate resistance value, wind a larger number of turns, and increase induced electromotive force.

An electric current needs to flow always in a constant direction in the PCB pattern voice coil of each layer, the PCB pattern voice coil of each layer has the same resistance value, a connection between the PCB pattern voice coils of layers does not include a jump or additional inefficient connection, and the input and output of a current signal need to be the front and rear of a multi-layer PCB pattern voice coil film. A serial connection between two layers is performed using a through hole at the central portion of the inside front end of a multi-layer PCB voice coil, and a parallel connection between the serially connected voice coils is performed by a connection between the outside front ends of PCB voice coils.

FIG. 3 is a plan view showing a first serial and parallel connection structure in the 6-layer stack structure of a multi-layer PCB pattern voice coil film in accordance with the present invention.

In accordance with Equation 2, in the 6-layer stack structure, the number of through holes formed in each of the PCBs 31*a* to 36*a* is 2 on both sides at locations corresponding to the outside front ends of the voice coil, and the number of through holes corresponding to the inside front end of the voice coil needs to be 3 at an internal central part.

The voice coil films 31 to 36 of the respective layers are designed to have the same number of turns and the same resistance value, and the inside front end 31*c* of a first-layer voice coil film 31 and the inside front end 36*c* of a sixth-layer voice coil film 36 are connected in series through the through hole 31*e* of the PCB 31*a*. Likewise, second-layer and fifth-layer voice coils 32 and 35 are connected in series. Likewise, third-layer and fourth-layer voice coils 33 and 34 are connected in series by connecting the inside front ends 33*c* and 34*c* of the third-layer and fourth-layer voice coils 33 and 34.

Thereafter, the outside front ends 31*d*, 32*d*, and 33*d* of the first-layer to the third-layer voice coil films 31, 32, and 33 are shorted and connected in parallel, and the outside front ends 34*d*, 35*d*, and 36*d* of the four-layer to the sixth-layer voice coil films 34, 35, and 36 are shorted and connected in parallel through the through holes of the PCBs 31*a* to 36*a*.

That is, when a total resistance value $R_{spec}$ is designed to have 8Ω in such a connection structure, the resistance value $R_{layer}$ of each layer is designed to have 12Ω in accordance with Equation 1. When the designed voice coil films are stacked as in FIG. 3 and connected in series and in parallel, the serial connections each by two layers form three serially connected voice coils each having 24Ω. When the three voice coils are connected in parallel, a total resistance value becomes 8Ω, that is, 24Ω/3.

Connection structures having other modified examples, such as FIGS. 4 and 5, are possible using the same method as that of FIG. 3.

FIG. 4 shows a structure in which first-layer and fourth-layer voice coil films 41 and 44 are connected in series, second-layer and fifth-layer voice coil films 42 and 45 are connected in series, third-layer and sixth-layer voice coil films 43 and 46 are connected in series, one ends of the first-layer to third-layer voice coil films 41 to 43 are shorted and connected in parallel, and the other ends of the four-layer to the sixth-layer voice coil films 44 to 46 are shorted and connected in parallel.

FIG. 5 shows a structure in which first-layer and second-layer voice coil films 41 and 42 are connected in series, third-layer and fourth-layer voice coil films 43 and 44 are connected in series, fifth-layer and sixth-layer voice coil films 45 and 46 are connected in series, one ends of the first-layer, the third-layer, and the fifth-layer voice coil films 41, 43, and 45 are shorted and connected in parallel, and the other ends of the second-layer, the four-layer and the sixth-layer voice coil films 42, 44, and 46 are shorted and connected in parallel.

In accordance with such a method, PCB pattern voice coil films can be produced freely and efficiently and applied easily. In even-numbered 4, 6, 8, 10 . . . multi-layer structures, induced electromotive force can be maximized very simply and a resistance value can also be managed and implemented. Accordingly, a high-output speaker can be fabricated.

Furthermore, if the layers of voice coils are connected in series and in parallel through holes, a multi-layer PCB pattern may be formed in each of the layers in the process, all the layers may be stacked, all the layers may be perforated so that the through holes of all the layers are formed therein, and electrical connections between all the layers may be completed through the electrical plating of the through holes of all the layers.

Or, if the layers of voice coils are connected in series and in parallel through holes, a multi-layer PCB pattern may be formed in each of the layers in the process, a layer may be perforated so that the through hole of the layer necessary in a stacking process is formed therein, and electrical connections between necessary layers may be completed through the electrical plating of the perforated through holes.

As described above, even in the case of voice coil films stacked in 8 layers or more other than 4 layers and 6 layers, a resistance value can be managed likewise, and stacked films can be connected in series and in parallel through holes.

While preferred embodiments of the present invention have been described with reference to the accompanying drawings, those skilled in the art to which the present invention pertains will understand that the present invention may be implemented in other detailed forms without departing from the technical spirit or essential characteristics of the present invention. Therefore, the aforementioned embodiments should not be construed as being limitative, but should be construed as being only illustrative from all aspects. Furthermore, the scope of the present invention is defined by the appended claims rather than the detailed description. It should be understood that all modifications or variations derived from the meanings and scope of the present invention and equivalents thereof are included in the scope of the present invention.

The invention claimed is:

1. A flat type speaker having a multi-layer Printed Circuit Board (PCB) pattern voice coil film, comprising:

voice coil films having voice coils printed on the voice coil films in PCB patterns and stacked in 4-layer or more even-numbered layers, wherein the voice coil film are connected in series by two, and the serially connected voice coil films are connected in parallel.

2. The flat type speaker of claim 1, wherein:

the multi-layer PCB pattern voice coil film satisfies Equation below.

$$L=2(n+1), \text{ and } R_{layer}=\tfrac{1}{2}*R_{spec}(n+1)$$

wherein L is a number of PCB layers, $R_{layer}$ is a design resistance value of each PCB layer, $R_{spec}$ is a target total resistance value of all the PCB layers, and n is a positive integer.

3. The flat type speaker of claim 1, wherein:

the voice coil is subject to pattern printing in a track form, the serial connection between the voice coil films is formed by a connection between inside front ends of the voice coils of the track form, and the parallel connection between the serially connected voice coil films is formed by a connection between outside front ends of the voice coils of the track form.

4. The flat type speaker of claim 1, wherein the serial and parallel connections between the voice coil films are performed through holes formed in the PCBs.

5. The flat type speaker of claim 4, wherein:

the through holes are formed at locations corresponding to an inside front end and outside front end of the voice coil of a track form, two through holes are formed in response to the outside front end, and an through hole corresponding to the inside front end satisfies Equation below.

$$L=2(n+1), \text{ and } N=\tfrac{1}{2}*L$$

wherein L is a number of PCB layers, N is a number of through holes formed in the PCB at a location corresponding to the inside front end of the voice coil, and n is a positive integer.

6. The flat type speaker of claim 1, wherein the parallel connection between the voice coil films is shorted and formed on an input side of a power source and is shorted and formed on an output side of the power source.

7. The flat type speaker of claim 1, wherein:

the serial and parallel connections between the voice coil films are formed through through holes formed in the PCBs, and the through holes are formed by perforating all layers or necessary layers in a state in which the voice coil films have been stacked or in a process of stacking the voice coil films so that all the layers or the necessary layers are connected in series and in parallel through electrical plating of all the layers or the necessary layers.

* * * * *